US012172205B2

(12) United States Patent
Bicego

(10) Patent No.: US 12,172,205 B2
(45) Date of Patent: Dec. 24, 2024

(54) METHOD FOR PRODUCING GOURMETTE JEWELLERY ARTICLES

(71) Applicant: MARCO BICEGO S.P.A., Trissino (IT)

(72) Inventor: Marco Bicego, Trissino (IT)

(73) Assignee: MARCO BICEGO S.P.A., Trissino (IT)

( * ) Notice: Subject to any disclaimer, the term of this patent is extended or adjusted under 35 U.S.C. 154(b) by 0 days.

(21) Appl. No.: 18/262,597

(22) PCT Filed: Jan. 20, 2022

(86) PCT No.: PCT/EP2022/051273
§ 371 (c)(1),
(2) Date: Jul. 24, 2023

(87) PCT Pub. No.: WO2022/157263
PCT Pub. Date: Jul. 28, 2022

(65) Prior Publication Data

US 2024/0300006 A1 Sep. 12, 2024

(30) Foreign Application Priority Data

Jan. 25, 2021 (IT) ..... 102021000001265

(51) Int. Cl.
*B21L 11/00* (2006.01)
*A44C 11/00* (2006.01)
(Continued)

(52) U.S. Cl.
CPC ..... *B21L 11/005* (2013.01); *A44C 11/00* (2013.01); *A44C 27/00* (2013.01); *B21L 9/04* (2013.01); *B21L 9/08* (2013.01); *B21L 11/06* (2013.01)

(58) Field of Classification Search
CPC .. Y10T 29/49588–29/49591; Y10T 29/49597; A44C 11/00;
(Continued)

(56) References Cited

U.S. PATENT DOCUMENTS 5,537,812 A * 7/1996 Rozenwasser ..... B21L 11/005 59/80
2018/0338588 A1 11/2018 Gasparini

FOREIGN PATENT DOCUMENTS

EP 1583623 A1 10/2005
FR 2446612 A1 * 8/1980
(Continued)

*Primary Examiner* — Matthew P Travers
(74) *Attorney, Agent, or Firm* — FISHERBROYLES, LLP.; Roger L. Browdy; James E. Mrose

(57) ABSTRACT

A description is given of a method for the production of gourmette jewellery articles comprising the steps consisting of: forming by cutting a series of links (10) starting from a metal plate; creating a reinforcing edge around said links; pressing in a mould said reinforced links to confer thereto an undulated shape; making a cut (41) which develops from the outer perimeter to the inner perimeter on some of said reinforced links (30), obtaining in this way a series of reinforced links provided with cut (40); attaching in sequence two reinforced links provided with cut (40) to an intact reinforced link (30), or two intact links to a link provided with cut, obtaining a chain wherein a reinforced link (30) alternates with a reinforced link provided with cut (40); and closing the cuts (41) previously formed in the reinforced links provided with cut (40).

8 Claims, 6 Drawing Sheets

(51) Int. Cl.

| | |
|---|---|
| ***A44C 27/00*** | (2006.01) |
| ***B21L 9/04*** | (2006.01) |
| ***B21L 9/08*** | (2006.01) |
| ***B21L 11/06*** | (2006.01) |

(58) Field of Classification Search
CPC ..... A44C 27/00–002; B21L 3/00; B21L 9/04; B21L 9/08; B21L 11/005; B21L 11/06
See application file for complete search history.

(56) References Cited

FOREIGN PATENT DOCUMENTS

| | | | |
|---|---|---|---|
| IT | VI96U000048 | U1 | 12/1997 |
| KR | 20100129622 | A | 12/2010 |

* cited by examiner

METHOD FOR PRODUCING GOURMETTE JEWELLERY ARTICLES

The present invention relates to a method for producing articles, in particular jewellery articles, such as bracelets, necklaces, earrings and the like, having a series of links or rings joined together in a chain or gourmette.

Specific reference will be made in this description to articles of fine jewellery, however the teachings of the invention are applicable to other sectors, such as costume jewellery, fashion accessories and the like.

BACKGROUND AND OBJECT OF THE INVENTION

Many types of bracelets or necklaces in metal are presented as a set of links or rings connected in sequence and articulated one to the other. A particularly appreciated aesthetic appearance is achieved through the use of flat or flattened surface links, commonly referred to as "gourmette", in which reciprocal penetration between the rings results in a particularly wavy line.

Traditionally, in order to make a gourmette jewellery article, the process starts with a series of rings made from extruded round wire, or obtained by microcasting, or again formed by hollow elements joined together to form a chain, which is subsequently pressed along the thickness to improve stability and give the classic flattened shape. The articles obtained in this way have a massive and rather heavy structure, which is often not appreciated by users and requires large quantities of raw material, which is normally expensive.

The Italian utility model issued for application VI96U000048 (in the new format 201996900523946) describes, for example, a method for the manufacture of necklaces formed by rings made from barrel material and having a C-shaped cross section. Each ring is provided with a slit along the inner perimeter and the closure of the slits is obtained by means of the insertion therein of a metal strip of thickness almost equal to the width of the slit.

KR20100129622A describes a device, and a related method, for producing a chain that comprises a series of components, and therefore of steps, resulting in a long, wasteful process and in a product in any case heavy.

In EP1583623A1 a method is described for producing chains for articles of jewellery in the form of a rope, comprising the steps of preparing a plurality of open rings, gripping and moving the rings so as to prepare a sequence of respective pairs of adjacent rings with respective openings facing each other and also joining the adjacent rings of each pair are to obtain a closed annular shape, the rings of adjoining pairs having first being inserted, so as to obtain a structure with linked rings. The method provides for the rings to be formed by cutting or stamping from sheet metal and for the adjacent rings of each pair to be joined to each other by the corresponding limbs.

US2018/338588A1 discloses a linking element for a modular jewel includes a single and continuous body showing at least one first portion, at least one second portion and at least one third portion, wherein at least one section of the at least one first portion is in close proximity to at least one portion of the at least one second portion, the at least one first portion, the at least one second portion and the at least one third portion delimiting between them at least one first through-opening through the body, wherein the at least one first portion and the at least one second portion are separated from each other by the at least one split selectively expandable/shrinkable to delimit/occlude an access passage to the at least one through-opening.

In the light of the prior art disclosed, there remains the problem of providing a method for producing gourmette jewellery articles with a lighter structure that allows for a simpler connection between the different rings.

The object of the present invention is to provide a method for producing gourmette jewellery articles in metal, more particularly precious metal, such as bracelets, necklaces, earrings and the like, which eliminates the disadvantages of the prior art and which is innovative and advantageous with respect to conventional methods.

More particularly, an object of the present invention is to provide a method for making gourmette jewellery articles having a lightweight structure.

A further object of the present invention is to provide such a method that allows gourmette jewellery articles to be obtained that are easily adapted to the anatomy of the user, due to the wavy, yet strongly flattened, nature of the single links.

These and other objects are achieved by a method for making jewellery articles according to the invention having the features listed in the appended independent claim 1.

Advantageous embodiments of the invention are disclosed by the dependent claims. Substantially, the present invention relates to a method for making gourmette jewellery articles comprising the steps consisting of:

- obtaining by cutting a series of links from a metal sheet;
- creating a reinforcing edge around said links;
- pressing said reinforced links into a mould to give them an undulated shape;
- making a cut that develops from the outer perimeter to the inner perimeter of some of said reinforced links, thus obtaining a series of reinforced links provided with a cut;
- attaching in sequence two reinforced links provided with cut to an intact reinforced link, or two intact links to a reinforced link provided with cut, obtaining a chain in which a reinforced link alternates with a reinforced link with cut;
- closing the cuts previously made in the reinforced links provided with cut.

BRIEF DESCRIPTION OF THE DRAWINGS

Further features of the invention will be made clearer by the following detailed description, referring to a purely illustrative, and therefore non-limiting, embodiment thereof illustrated in the accompanying drawings, wherein.

DETAILED DESCRIPTION OF THE INVENTION

A detailed description will now be given, with reference to the accompanying drawings, of a method for making gourmette jewellery articles according to the present invention, which begins with the production of the single links from a thin metal plate, for example with a thickness of approximately 0.3 mm, which is appropriately cut to obtain semi-finished links 10. The plate may be of any metal, in particular a precious metal, such as gold and the like.

Figure 1B:
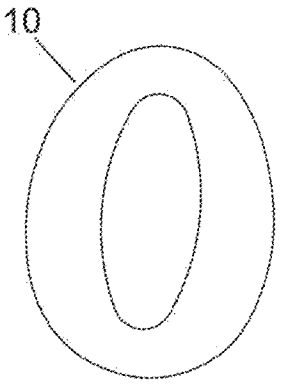
FIGS. 1*a* and 1*b* are, respectively, an axonometric view and a plan view of a cut (semi-finished) link used to make an item of jewellery by the method according to the present invention.
Figure 1A:
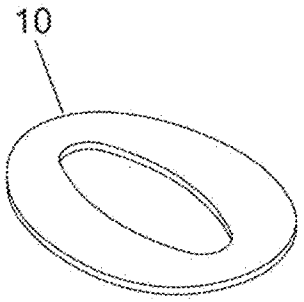

FIGS. 1*a* and 1*b* are illustrative views of a cut link 10 having an outer perimeter and a hole that delimits an inner perimeter. In the various drawings, a preferred embodiment of the links 10 is shown with elongated, ovoid or vaguely elliptical shape.

Figure 2A:
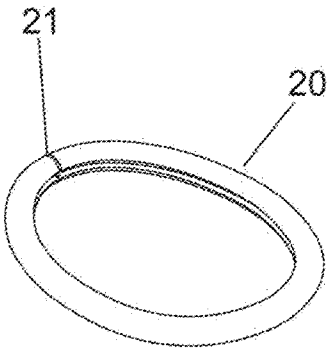
FIGS. 2*a* and 2*b* are, respectively, an axonometric view and a plan view of a profile with which to wrap the cut links.
Figure 2B:
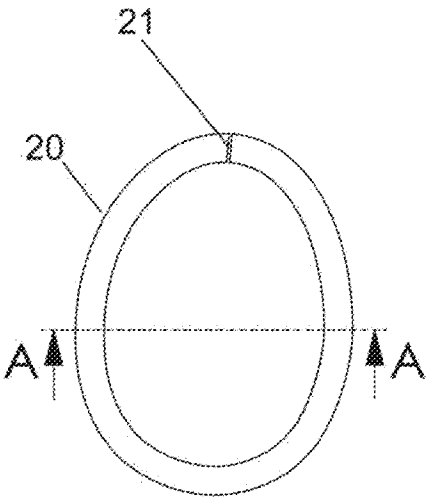
Figure 2C:
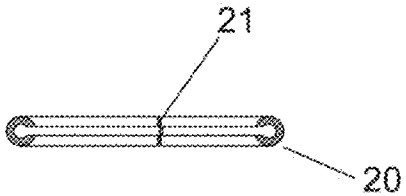
FIG. 2*c* is a sectional view taken along line A-A of FIG. 2*b;*

After having made the links 10, a metal profile 20, shown axonometrically in FIG. 2*a* and in plan view in FIG. 2*b*, is wrapped around their outer perimeter. The metal profile is generally obtained starting from an open barrel of deformable material, i.e. having an opening that runs longitudinally, wrapped around a section shaped according to the shape of the perimeter of the cut link 10 so as to assume the shape thereof and making a cut 21, so as to obtain an open shaped profile, as can be seen in FIG. 2*c*, which shows a section view of the metal profile 20 taken along line A-A of FIG. 2*b*.

Figure 3C:
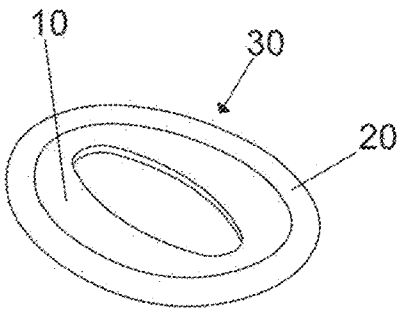
FIG. 3*c* is a view showing a link reinforced with the metal profile.
Figure 3B:
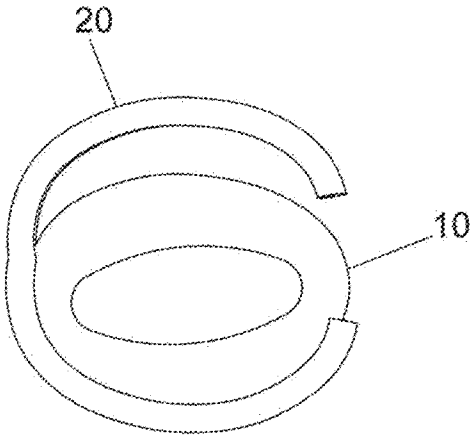
FIGS. 3*a* and 3*b* are views showing a metal profile in the phase of wrapping around a cut link.
Figure 3A:
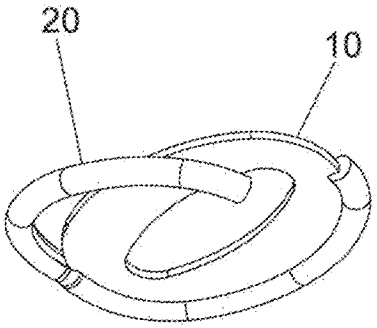

The metal profile 20 can therefore be applied by simply spreading apart the ends thereof and making it fit on the outer perimeter of the link 10, as shown in FIGS. 3*a* and 3*b*. The application of the profile 20 to the link 10, in addition to giving a pleasing and distinctive aesthetic effect, gives greater rigidity to the whole and prevents the edge of the cut element from causing injury to the user.

To ensure that the elements are joined, it is possible to weld some points of profile 20 to the outer perimeter of link 10 beforehand. For example, one end of the profile 20 is fixed, by laser welding, in a first point corresponding to one of the vertices placed on the larger axis of link 10 and in a second point corresponding to the opposite vertex. The laser welding is completed by joining again the ends of profile 20 in the first point.

Other welding methods are naturally possible.

Subsequently, the composite piece formed by the joining of profile 20 and link 10 is made to pass through a tunnel furnace to weld the two elements completely one to the other. At the end of this phase, a reinforced link 30 such as that shown in FIG. 3*c* is obtained.

Figure 4C:
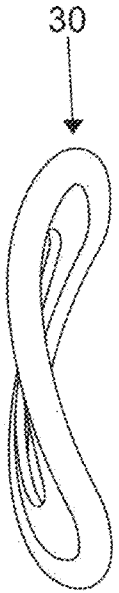
FIGS. 4*a*, 4*b* and 4*c* are views showing a reinforced and moulded link.
Figure 4B:
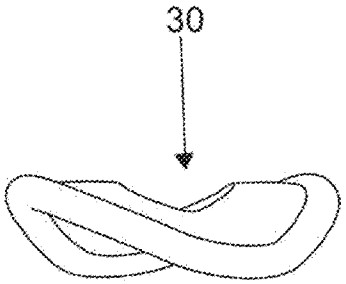
Figure 4A:
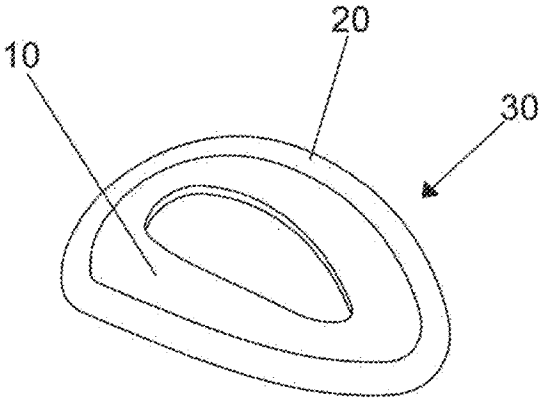

According to a preferred aspect of the invention, the reinforced links 30 thus produced can be bent by means of suitable dies to give a characteristic undulated shape, shown in FIGS. 4*a*, 4*b* and 4*c*, and to allow regular jointing between the links once they are concatenated one to the other.

Figure 5:
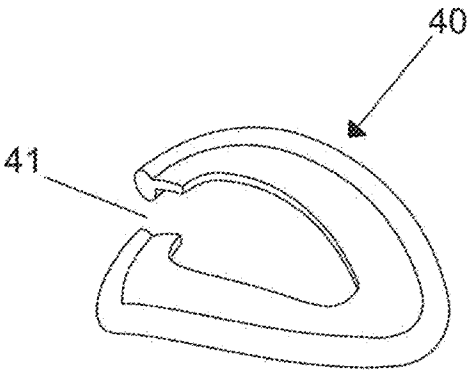
FIG. 5 is a view showing a reinforced and moulded link on which a cut is made.

The step of assembly of the reinforced links 30 provides for making a cut 41 (FIG. 5) on some thereof extending from the outer to the inner perimeter or vice versa. With reference to the embodiment illustrated in the various drawings of links 10 of elongated shape, the cut is preferably made at one of the vertices placed along the larger axis, in order to obtain a reinforced link with cut 40.

Figure 6:
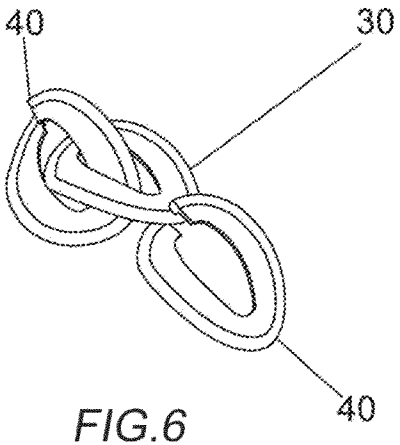
FIG. 6 is a view in which two links with a cut are attached to a link without cut.

The links provided with cut 40 can thus be attached to intact reinforced links 30 in order to obtain a chain. Advantageously, as shown in the chain section formed by three links in FIG. 6, two links provided with cut 40 are attached to an intact reinforced link 30 or two intact links to a link provided with cut, so as to create a chain in which an intact reinforced link 30 and a reinforced link with cut 40 are repeated alternately.

Figure 7B:
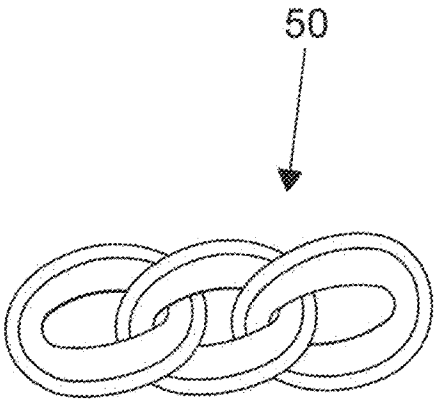
FIGS. 7*a* and 7*b* are views showing a section of a chain obtained by the method according to the present invention.
Figure 7A:
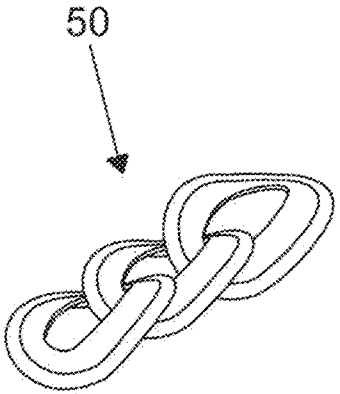

Once the sequence of links has been arranged, the cuts 41 made in the links provided with cut 40 are suitably closed by welding so as to obtain a chain 50 of reinforced links (FIGS. 7*a* and 7*b*).

Naturally, the present invention is not limited to the particular embodiment described previously and illustrated in the accompanying drawings, but numerous detailed changes may be made thereto, within the reach of the person skilled in the art, without thereby departing from the scope of the invention itself, as defined in the appended claims.

The invention claimed is:

1. A method for making gourmette jewellery articles comprising the steps of:

obtaining, by cutting, a series of links from a metal plate;

creating a reinforcing edge around each of said links to form reinforced links;

pressing said reinforced links into a mould to give them an undulated shape;

making a cut that develops from an outer perimeter to an inner perimeter, or vice versa, on some of said reinforced links, obtaining in this way a set of cut reinforced links;

attaching in sequence two cut reinforced links to an uncut reinforced link, or two uncut reinforced links to a cut reinforced link, obtaining a chain in which an uncut reinforced link alternates with a cut reinforced link;

closing the cuts previously made in the cut reinforced links.

2. The method according to claim 1, wherein the reinforcing edge is obtained by applying and joining a metal profile around an outer perimeter of each of said links.

3. The method according to claim 2, wherein said metal profile is obtained starting from an open barrel made of a deformable material having an opening that runs longitudinally.

4. The method according to claim 3, wherein said open barrel is wound around a shaped section according to the shape of the outer perimeter of the cut link so as to assume the shape thereof and making a cut so as to obtain an open shaped profile.

5. The method according to claim 2, wherein the metal profile is joined to the outer perimeter of the links by welding.

6. The method according to claim 2, wherein the metal profile is joined to the outer perimeter of the links by localized laser welding in two or more points and elements thus obtained are subsequently passed through a tunnel furnace for complete welding.

7. The method according to claim 1, wherein said links have an elongated, ovalized or elliptical shape.

8. A Gourmette jewellery article obtained by the method according to claim 1.

* * * * *